US005164600A

United States Patent [19]

Das et al.

[11] Patent Number: 5,164,600

[45] Date of Patent: Nov. 17, 1992

[54] DEVICE FOR SENSING THE PRESENCE OF A FLAME IN A REGION

[75] Inventors: Promit Das; Terrance R. Kinney, both of South Bend, Ind.

[73] Assignee: Allied-Signal Inc., Morristown, N.J.

[21] Appl. No.: 628,961

[22] Filed: Dec. 13, 1990

[51] Int. Cl.[5] ..... G01J 3/00; G08B 17/12

[52] U.S. Cl. ..... 250/554; 250/227.23; 250/226; 340/578

[58] Field of Search ..... 250/554, 227.23, 339, 250/342, 226; 340/578

[56] References Cited

U.S. PATENT DOCUMENTS

| | | | |
|---|---|---|---|
| 3,307,608 | 3/1967 | Cowan | 340/578 |
| 3,692,415 | 9/1972 | Shiller | 250/554 |
| 4,227,369 | 10/1980 | Williams | 60/734 |
| 4,322,723 | 3/1982 | Chase | 340/578 |
| 4,639,717 | 1/1987 | De Meirsman | 340/578 |
| 4,691,196 | 9/1987 | Kern et al. | 340/578 |
| 4,742,236 | 5/1988 | Kawakami et al. | 340/578 |
| 4,855,718 | 8/1989 | Cholin et al. | 250/554 |
| 4,878,831 | 11/1989 | Ewing | 340/578 |
| 4,896,965 | 1/1990 | Gott et al. | 250/554 |
| 4,983,853 | 1/1991 | Davall et al. | 250/554 |

FOREIGN PATENT DOCUMENTS

| | | |
|---|---|---|
| 0046587 | 3/1982 | European Pat. Off. . |
| 2390781 | 12/1978 | France |
| 2188416 | 9/1987 | United Kingdom . |
| 8604664 | 8/1986 | World Int. Prop. O. . |

*Primary Examiner*—David C. Nelms
*Assistant Examiner*—Michael Messinger
*Attorney, Agent, or Firm*—Leo H. McCormick, Jr.; Larry J. Palguta; Robert A. Walsh

[57] ABSTRACT

A light off detecting arrangement for sensing the presence of a flame in a region such as the afterburner of a turbine engine is disclosed. An optical focusing device such as a lens or mirror is located near a quartz window adjacent the afterburner for concentrating electromagnetic radiation emanating from the region. An optical (fiber optic) pathway receives the concentrated electromagnetic radiation from the optical focusing device and conveys that radiation thru the optic filters to an opto-electrical converter for converting incident electromagnetic radiation to electrical signals. A frequency selective optical device such as an infrared filter is interposed between the optical focusing device and the opto-electrical converter for insuring that a preselected portion only of the electromagnetic radiation emanating from the region is converted to electrical signals. The electrical signals are compared to a predetermined threshold value and a fault flame present indication is issued if the comparison indicates sufficient radiation in the preselected portion indicative of the presence of a flame, and a second no flame indication is issued otherwise.

8 Claims, 1 Drawing Sheet

DEVICE FOR SENSING THE PRESENCE OF A FLAME IN A REGION

The present invention relates generally to a sensing device for determining whether a light is present and more particularly to a device for sensing the presence of a flame in the main burner or afterburner of a turbine engine.

The current technique for detecting a "flame-out" in turbine afterburners (augmenters) is through the use of an optical device, typically a photos multiplier tube, which detects the presence of ultra-violet emissions from the combustion of fuel. Although widely used, these devices have low reliability, are very heavy yet delicate and consume excessive amounts of electrical power. The low reliability of these devices can be attributed to the use of Geiger-Mueller type tubes and to the low level of ultra-violet emissions of afterburner fuels. This very low level of ultra-violet emission is due to the high fuel to air ratio in which the fuel is burned.

Attempts to simply detect the abundant visible portion of the radiation from such a flame have not been fruitful because of masking by the more abundant background infrared radiation caused by the heat produced by the main flame within the engine.

Applicants' attempts to optically sense for the ultra-violet radiation component from an afterburner flame have not met with success because of the low sensitivity of most photodetectors and the poor transmission characteristics of fibers in this frequency range. To circumvent these problems, Applicants' attempted placing a phosphor in the sensor for converting the ultra-violet to a longer, and more readily sensed and transmitted, wavelength. Tests with this arrangement indicated that it was unacceptable due to frequently inadequate ultra-violet radiation in the flame region for the sensor to detect. Also acceptable variations in the fuel/air ratio gave unacceptable variations in the levels of ultra-violet radiation.

Among the several objects of the present invention may be noted the provision of an afterburner flame present sensor which overcomes the above noted deficiencies; the provision of an afterburner flame present sensor of reduced weight, reduced susceptibility to electromagnetic interference, and improved reliability; the provision of a passive light off detector; the provision of an optical flame sensor employing fiber optic information transmission to a central location; and the provision of a light weight, low maintenance, automatic flame sensing device.

As noted earlier, attempts to detect the visible Portion of the radiation from a flame generally failed because of masking by the more abundant background infrared radiation. If a way could be found to unmask this visible radiation, then a reliable sensor might be achieved.

It is a further object of the present invention to detect flame generated radiation in a monitored region by comparing visible and infrared radiation levels from that region. These as well as other objects and advantageous features of the present invention will be in part apparent and in part pointed out hereinafter.

In general, a sample of the light emission from the burner section is captured and conducted to a detection interface and an opto-electronic interface compares a predetermined spectral width of visible emission with a predetermined spectral width of infrared emission to determine if a flame is present in the burner section.

An alternative arrangement for sensing for the presence of a flame in a region is also disclosed and includes a device such as a lens for collecting a broadband sample of electromagnetic radiation from the region along with an arrangement such as two or more filters or a frequency selective reflective surface for effecting a frequency selective separation of the collected radiation into at least a first lower frequency component and a second higher frequency component. The magnitudes of the first and second frequency components are then compared to determine when a flame is present in the region.

The exemplifications set out herein illustrate a preferred embodiment of the invention in one form thereof and such exemplifications are not to be construed as limiting the escape of the disclosure or the scope of the invention in any manner.

DESCRIPTION OF THE PREFERRED EMBODIMENT

Figure 1:
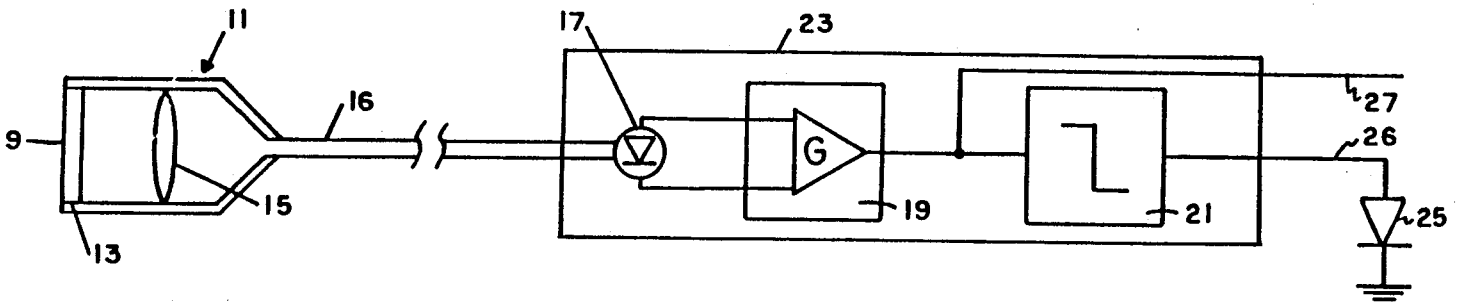
FIG. 1 is a schematic diagram of a light off detector illustrating the present invention in one form thereof.

Referring first to FIG. 1, an arrangement including a sensor 11 and an opto-electrical interface 23 for sensing for the presence of a flame in a region such as an afterburner 9 is shown. The sensor 11 includes an infrared filter 13 for passing a predetermined part only of the infrared portion of the spectrum, and an optical focusing device for concentrating electromagnetic radiation emanating from the region and passing through the filter such as light concentrating lens 15. An optic fiber 16 extends from the sensor 11 to the opto-electric interface 23 providing an optical pathway for conveying the radiation to the opto-electrical converter. The opto-electrical interface includes the photodetector 17, gain stage 19 and comparator 21. Thus, the sensor is totally passive until the opto-electrical interface 23 is reached. Comparator 21 is preferably a digital device including at its input an analog to digital converter. The threshold on comparator 21 is set to a mean value measured during previous engine tests and the output on line 25 may be used to simply drive an indicator such as a light emitting diode 25 and/or to provide TTL logic signals for further processing as desired. When the light emitting diode is enabled, the frequency selective filter 13 insures that a preselected portion only of the electromagnetic radiation emanating from the region is converter to electrical signals. If the comparison indicates sufficient radiation is present in the preselected portion indicative of the present of a flame, light emitting diode 25 is energized. A second no flame indication in the form of no energization of the LED 25 is otherwise provided. An analog output indicative of the received light intensity may also be provided on line 27 if desired.

Figure 2:
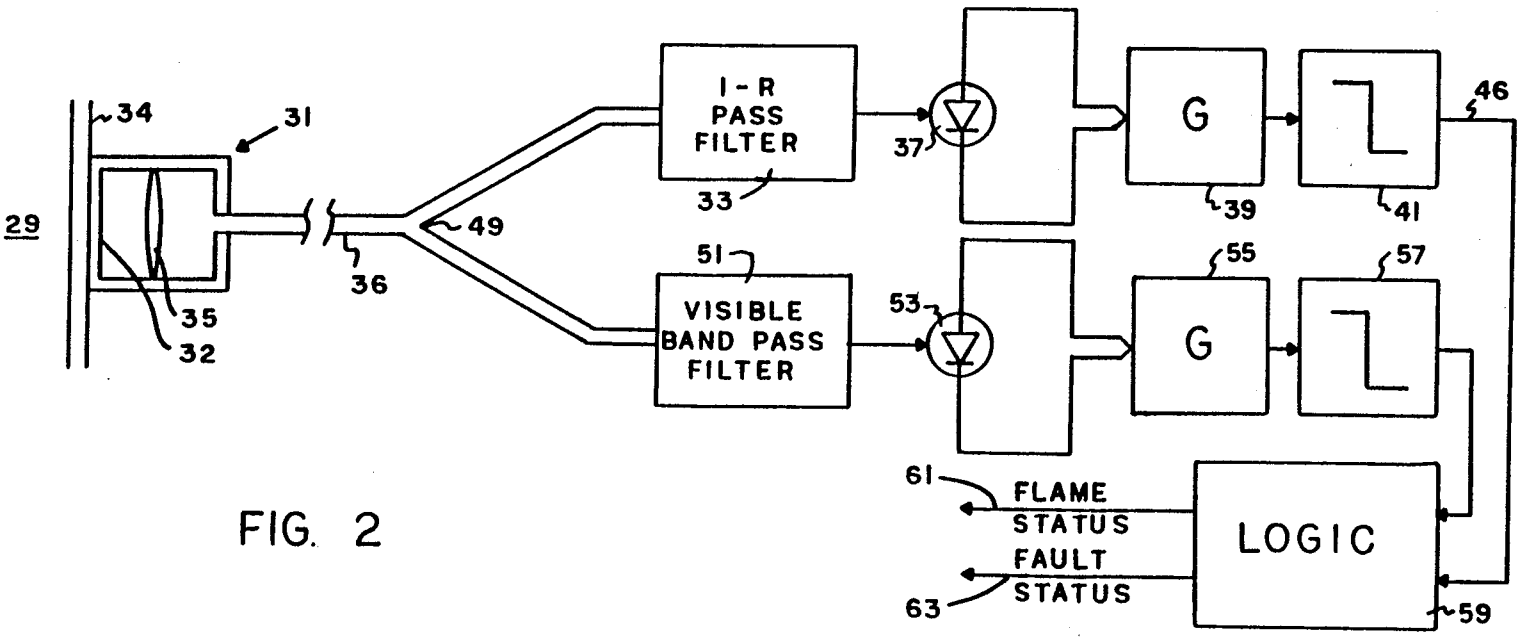
FIG. 2 is a schematic diagram of a light off detector illustrating a modification of the present invention.

Turning now to FIG. 2, an arrangement for sensing the presence of a flame in a region 29 such as an illustrative afterburner includes an optical focusing device such as lens 35 fixed to a wall or engine case 34 at a quartz window 32 which allows radiation from within to reach lens 35. The lens 35 is a converging lens which concentrates electromagnetic radiation emanating from the region 29 onto an optical pathway such as the optic fiber 36 which receives the concentrated electromagnetic radiation from the optical focusing device such as converging lens 35, and conveys that radiation to a fork or bifurcation 49 where the radiation splits into two branches. The infrared portion of the light in the upper branch passes through filter 33 and on to the optical detector 37. The visible portion of the light in the lower branch passes through filter 51 and on to the optical detector 53. Thus, the bifurcation 49 and two subsequently filters form a means for effecting a frequency selective separation of electromagnetic radiation into at least a lower frequency component on the upper branch leading to detector 37, and a higher frequency component on the lower branch. Preferably the filters have non-overlapping passbands and separate the radiation into a first component of a predetermined bandwidth within the infrared portion of the spectrum and a second higher frequency component of a predetermined bandwidth within the visible portion of the spectrum. Detector 37 provides a first electrical signal indicative of the magnitude of the lower frequency component to amplifier 39, and detector 53 provides a second electrical signal indicative of the magnitude of the higher frequency component to the amplifier 55. Analog to digital conversion is effected by the converters 41 and 57, and their respective outputs compared by the logic circuitry 59. An output indication is provided on line 61 if the two compared electrical signals are within predetermined limits indicative of the presence of a flame in region 29, and a second indicating a fault such as a broken fiber is otherwise provided on line 63.

The entire structure to the left of the detectors 37 and 53 is passive and has as one of its two primary purposes the conveyance of radiation from the region 29 to a remote location where electronic equipment is located. The other primary purpose of this passive optical portion of the system is to segregate two samples of the radiation from region 29, one a portion of the visible spectrum and the other a part of the infrared portion of the spectrum. These two functions may be accomplished in a multitude of ways.

Sensor 31 may be replaced with a frequency selective reflector (focusing or plane) so that a certain spectral portion passes through the reflector while another is reflected. Two fiber optics could then pick up the two spectral components and convey them to the remote location. A similar "beam splitting mirror" could replace the bifurcation at 49. Two separate windows with dissimilar filters could also be employed.

The electrical portion of the system may also be implemented in a number of ways. For example, the signals from converters 41 and 57 could be independently compared to predetermined fixed values and a fault signal issued on line 63 if either signal fails to be within prescribed limits.

From the foregoing, it is now apparent that a novel optical flame sensing arrangement has been disclosed meeting the objects and advantageous features set out hereinbefore as well as others, and that numerous modifications as to the precise shapes, configurations and details may be made by those having ordinary skill in the art. As one final example, the optical fiber conduit may lead to the spectral dispersion device such as a prism, diffraction grating or similar device rather than the bifurcation and filter arrangement described in conjunction with FIG. 2. An array of appropriately positioned photodetectors would convert their respective incident spectral portions into electrical signals for comparison.

We claim:

1. An arrangement for sensing for the presence of a flame in a region of an engine comprising:

an optical focusing device for concentrating electromagnetic radiation emanating from the region of an engine;

means for effecting a frequency selective separation of electromagnetic radiation into at least a lower frequency component and a higher frequency component, the means for effecting a frequency selective separation comprising first and second optical filters having non-overlapping passbands;

an optical pathway for receiving the concentrated electromagnetic radiation from the optical focusing device and conveying that radiation to the means for effecting a frequency selective separation, the optical pathway including a bifurcation defining two branches with one optical filter located in one branch between the bifurcation and a first means and the other optical filter located in the other branch between the bifurcation and a second means;

said first means responsive to the means for effecting a frequency selective separation for providing a first electrical signal indicative of the magnitude of the lower frequency component;

said second means responsive to the means for effecting a frequency selective separation for providing a second electrical signal indicative of the magnitude of the higher frequency component; and means responsive to the first and second electrical signals for providing a first indication if the first and second electrical signals are within predetermined limits indicative of the presence of a flame, and a second no flame indication otherwise.

2. The arrangement for sensing the presence of a flame in a region as set forth in claim 1 wherein the optical focusing device comprises a converging lens.

3. An arrangement for sensing for the presence of a flame in a region of an engine comprising:

means for collecting a broadband sample of electromagnetic radiation from the region of an engine;

means for effecting a frequency selective separation of the collected radiation into at least a first lower frequency component and a second higher frequency component, the first lower frequency component comprising a predetermined bandwidth within the infrared portion of the spectrum and the second higher frequency component comprising a predetermined bandwidth within the visible portion of the spectrum; and means for comparing the magnitudes of the first and second frequency components to determine when a flame is present in the region of an engine.

4. The arrangement for sensing the presence of a flame in a region as set forth in claim 3 wherein the means for effecting comprises a pair of optical filters.

5. An arrangement for sensing for the presence of a flame in a region of an engine comprising:

an optical focusing device for concentrating electromagnetic radiation emanating from the region;

an opto-electrical converter for converting incident electromagnetic radiation to electrical signals;

an optical pathway for receiving the concentrated electromagnetic radiation from the optical focusing device and conveying that radiation to the opto-electrical converter;

a frequency selective optical device interposed between the region and the opto-electrical converter for insuring that a preselected portion only of the electromagnetic radiation emanating from the region is converted to electrical signals; and means for comparing the electrical signals to a threshold value determined by previous engine tests and for providing a first indication if the comparison indicates sufficient radiation in the preselected portion indicative of the presence of a flame, and a second no flame indication otherwise.

6. The arrangement for sensing for the presence of a flame in a region of an engine as set forth in claim 5 wherein the frequency selective optical device comprises an infrared filter for passing a predetermined part only of the infrared portion of the spectrum.

7. The arrangement for sensing the presence of a flame in a region of an engine as set forth in claim 5 wherein the optical focusing device comprises a converging lens.

8. The arrangement for sensing the presence of a flame in a region of an engine as set forth in claim 5 wherein the frequency selective optical device comprises an infrared passing optical filter.

* * * * *